US006355118B1

(12) United States Patent
Taylor

(10) Patent No.: US 6,355,118 B1
(45) Date of Patent: Mar. 12, 2002

+

(54) PROTECTIVE COARSENING ANNEAL FOR ZIRCONIUM ALLOYS

(75) Inventor: Dale Frederick Taylor, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/638,493

(22) Filed: Aug. 15, 2000

Related U.S. Application Data

(60) Division of application No. 09/186,013, filed on Nov. 4, 1998, now Pat. No. 6,126,762, which is a continuation-in-part of application No. 09/050,186, filed on Mar. 30, 1998, now abandoned.

(51) Int. Cl.[7] ..... C22C 16/00
(52) U.S. Cl. ..... 148/421; 420/422
(58) Field of Search ..... 148/421, 672; 420/422; 376/414, 416, 417, 421, 457, 900

(56) References Cited

U.S. PATENT DOCUMENTS

| | | | | |
|---|---|---|---|---|
| 3,645,800 A | | 2/1972 | Mock et al. | |
| 4,238,251 A | | 12/1980 | Williams et al. | |
| 4,360,389 A | | 11/1982 | Urquhart | 148/11.5 F |
| 4,521,259 A | | 6/1985 | Eucken | |
| 4,717,428 A | * | 1/1988 | Comstock et al. | |
| 4,863,685 A | | 9/1989 | Taylor | |
| 4,876,064 A | | 10/1989 | Taylor | |
| 4,986,957 A | * | 1/1991 | Taylor | 376/417 |

(List continued on next page.)

FOREIGN PATENT DOCUMENTS

| | | |
|---|---|---|
| FR | 2302569 | 9/1976 |
| FR | 2368547 | 5/1978 |
| JP | 60050155 | 3/1985 |

OTHER PUBLICATIONS

"Progress In The Knowledge Of Nodular Corrosion", by Friedrich Garzarolli et al., Zirconium in the Nuclear Industry; Seventh International Symposium, ASTM SPT 939, R.B. Adamson and L.F.P. Van Swan. Eds.. American Society for Testing and Materials.

"An Oxide–Semi Conductance Model of Nodular Corrosion and Its Application To Zirconium Alloy Development", by D.F. Taylor, Journal of Nuclear Materials, 184 (1991) pp. 65–77.

J.P Foster et al., "Influence of Final Recrystallization Heat Treatment of Zircaloy–4 Strip Corrosion" 173 Journal of Nuclear Materials 164–178 (1990).

*Primary Examiner*—John Sheehan
(74) *Attorney, Agent, or Firm*—Robert P. Santandrea; Noreen C. Johnson

(57) ABSTRACT

A method for increasing the resistance of zirconium alloy tubing to nodular corrosion by applying a protective anneal at a temperature within a clearly defined temperature range. Also, a zirconium alloy tubing having such protective anneal is disclosed. The protective anneal comprises heating exposed surfaces of zirconium tubing to a temperature range bounded at its lower limit by the temperature $T_c$, $T_c$ being the temperature which at equilibrium conditions a critical concentration of solute exists in α-matrices of the zirconium alloy to resist nodular corrosion, and bounded at its upper limit by the maximum temperature at which precipitates exist in association with the α and β matrices in the particular zirconium alloy. In respect of Zircalloy-2 containing zirconium and the following metals by weight, namely 1.2–1.7% tin, 0.13–0.20% iron, 0.06–0.15% chromium, and 0.05–0.08% nickel, the lower temperature limit $T_c$ is approximately 840 C and the upper limit is approximately 855 C.

7 Claims, 8 Drawing Sheets

U.S. PATENT DOCUMENTS

| | | | | | |
|---|---|---|---|---|---|
| 5,024,809 | A | | 6/1991 | Taylor | |
| 5,026,516 | A | * | 6/1991 | Taylor | 376/416 |
| 5,073,336 | A | | 12/1991 | Taylor | |
| 5,188,676 | A | | 2/1993 | Taylor | |
| 5,436,947 | A | | 7/1995 | Taylor | |
| 5,437,747 | A | | 8/1995 | Adamson et al. | 148/519 |
| 5,469,481 | A | | 11/1995 | Adamson et al. | 376/416 |
| 5,519,748 | A | | 5/1996 | Adamson et al. | 376/457 |
| 5,699,396 | A | * | 12/1997 | Taylor | 376/416 |
| 5,991,352 | A | | 11/1999 | Taylor | 376/260 |

* cited by examiner

EXPERIMENTAL RESULTS FOR DETERMINATION OF $T_c$ AT EQUILIBRIUM
COOLING REGIME 1010°C → 840/830 → T (°C) (hold @T (°C) for t hours)

| t hr | 840 | 839 | 838 | 837 | 836 | 835 | 834 | 833 | 832 | 831 | 830 | 829 | 828 | 827 | 826 | 825 | 824 | 823 | 822 | 821 | 820 | 819 | 818 |
|---|---|---|---|---|---|---|---|---|---|---|---|---|---|---|---|---|---|---|---|---|---|---|---|
| 0 | - | - | - | - | - | - | - | - | x | x | x | x | x | x | x | x | x | x | x | x | x | x | x |
| 2 | - | - | - | - | - | - | - | - | - | - | - | x | x | x | x | ✓ | ✓ | ✓ | - | ✓ | - | ✓ | - |
| 5 | - | - | - | - | - | - | - | - | - | - | - | x | x | x | ✓ | - | ✓ | - | ✓ | - | ✓ | - | ✓ |
| 18 | - | - | - | - | x | x | x | ✓ | ✓ | ✓ | - | ✓ | - | ✓ | - | ✓ | - | ✓ | - | ✓ | - | ✓ | - |
| 48 | x | x | x | ✓ | ✓ | ✓ | ✓ | - | - | - | - | - | - | - | - | - | - | - | - | - | - | - | - |

| t hr | 817 | 816 | 815 | 814 | 813 | 812 | 811 | 810 | 809 | 808 |
|---|---|---|---|---|---|---|---|---|---|---|
| 0 | x | x | x | x | x | ✓ | - | ✓ | - | ✓ |
| 2 | ✓ | - | ✓ | - | - | - | - | - | - | - |
| 5 | - | - | - | - | - | - | - | - | - | - |
| 18 | ✓ | - | - | - | - | - | - | - | - | - |
| 48 | - | - | - | - | - | - | - | - | - | - |

✓ = Nodular Corrosion Present
x = No Nodular Corrosion Present
- = Denotes No Test Sample Obtained

FIG. 2

PROTECTIVE COARSENING ANNEAL FOR ZIRCONIUM ALLOYS

This is a divisional of U.S. Ser. No. 09/186,013, filed Nov. 4, 1998, now U.S. Pat. No. 6,126,762 which is a continuation-in-part application of U.S. Ser. No. 09/050,186, filed Mar. 30, 1998 now abandoned, which are hereby incorporated by reference.

FIELD OF THE INVENTION

The invention relates to a metallurgical process involving zirconium alloys, and more particularly to a process for treating zirconium alloys to immunize and improve resistance of such alloys to nodular corrosion when exposed to high pressure steam.

BACKGROUND OF THE INVENTION

Nuclear reactors utilize water/steam as a coolant for the reactor as well as a source of energy to power steam turbines to thereby provide electrical energy. Nuclear reactors typically have their nuclear fissionable material contained in sealed cladding tubes, generally of a zirconium alloy, for isolation of the nuclear fuel from the water/steam. Zirconium and its alloys are widely used as nuclear fuel cladding since they advantageously possess low neutron absorption cross-sections, and at temperatures below about 398 C (the approximate core temperature of an operating nuclear reactor), are non-reactive and importantly possess high corrosion resistance relative to other metal alloys in the presence of de-mineralized water or steam. Two widely used zirconium alloys ("Zircaloys") are "Zircaloy-2" and "Zircaloy-4", trade names of Westinghouse Electric Corporation for zirconium alloys of the above chemical compositions. Zircaloy-2, a Zr—Sn—Ni—Fe—Cr alloy, is generally comprised (by weight) of approximately 1.2–1.7% tin, 0.13–0.20% iron, 0.06–0.15% chromium and 0.05–0.08% nickel. Zircaloy-4 has essentially no nickel, and about 0.2% iron, but is otherwise substantially similar to Zircaloy-2. Zircaloy-2 has enjoyed widespread use and continues to be used at present in nuclear reactors. Zircaloy-4 was developed as an improvement to Zircaloy-2 to reduce problems with hydriding, which causes Zircaloy-2 to become brittle when cooled to ambient temperatures (ie. when the reactor is shut down) after absorbing hydrogen at higher temperatures.

Zirconium alloys are among the best corrosion resistant materials when exposed to steam at reactor operating temperatures (less than 398 C, typically 290 C) in the absence of radiation from nuclear fission reactors. The corrosion rate in absence of neutron bombardment is very low and the corrosion product is a uniform, black $ZrO_2$ oxide film/layer which forms on exterior surfaces of Zircaloy exposed to high temperature steam (uniform corrosion). The black oxide layer of $ZrO_2$ usually contains a small (non-stoichiometric) excess of zirconium, and as such, it contains excess electrons giving it a black or gray color. It is also highly adherent to zirconium or Zircaloy surfaces exposed to steam.

Despite such relatively high corrosion resistance, when Zircaloys are used as cladding and exposed to high neutron flux in nuclear reactors, corrosion rates are generally increased, and cladding corrosion does become a potential problem in Pressurized Water Reactors (PWR's) and particularly Boiling Water Reactors (BWR's), where corrosion occurs in two formats, namely increased uniform corrosion as mentioned above, and alternatively, a second form, namely, nodular corrosion. Nodular corrosion is a highly undesirable, white, stoichiometric $ZrO_2$ oxide layer ("bloom") which forms on the surface of the cladding. It tends to form as small patches ("nodules" or "pustules") on the surface of Zircaloys. Today, it is increasingly common to operate nuclear reactors at high "burn-up" (ie. to nearly complete consumption of the nuclear fuel). Under these conditions, the cladding is exposed to neutron flux for longer periods, which generally tends to increase the severity of nodular corrosion. Such increased nodular corrosion not only shortens the service life of the tube cladding (since when concentrated nodular corrosion acts in conjunction with certain contaminants—such as copper ions—localized spalling and ultimately penetration of the cladding can occur), but also produces a detrimental effect on the efficient operation of the reactor. In particular, the white $ZrO_2$, being less adherent than black $ZrO_2$, is prone to spalling or flaking away from the tube and entering into the reactor water, with detrimental effects. On the other hand, if the white nodular corrosion product does not spall away but remains on the tubing, a decrease in rapidity of heat transfer through the Zircaloy tube into the water cooling medium occurs when the less-dense white $ZrO_2$ oxide layer covers an increasingly large portion of the Zircaloy tube exterior surface, and the reactor becomes less thermally efficient. Thus, nodular corrosion can become a significant problem for Zircaloy cladding in situations where Zircaloy tube cladding is left in the nuclear reactor for longer periods in conditions of high "burn-up".

Zircaloys used in cladding for nuclear fuel rods are generally subject during their manufacture to a variety of heat treatments and anneals during the formation of the tubular cladding. It is known that the various heat treatments and quenching procedures used in forming a Zircaloy billet, and the various anneals and cold-working thereafter to form the Zircaloy tube cladding, all have an effect on the particular Zircaloy tubing's ability to resist nodular corrosion, with some Zircaloys able to withstand nodular corrosion better than others despite both being of identical chemical composition. For example, fine grained equiaxed $\alpha$ Zircaloy-2, heated to 1010 C and slow-cooled at a rate of 18 C/hr. to 600 C and thereafter quenched, exhibits a high susceptibility to nodular corrosion under the standard steam test (510 C, 1500 psig, 24 hr.). Paradoxically, the same material, if simply quenched from 1010 C, or if heated to only 950 C and cooled at the same rate of 18 C/hr. to 600 C and thereafter quenched, exhibits high resistance to corrosion under the same standard steam test.

The actual physical changes in the structural properties of zirconium alloys during manufacturing processes of nuclear fuel tubing made therefrom were little understood, and it was therefore, prior to this invention, difficult to conceive of the best ways to immunize such fuel tubing to nodular corrosion. U.S. application Ser. No. 09/050,214 by the same inventor, filed Mar. 30, 1998 entitled "Method for Determining Corrosion Susceptibility of Nuclear Fuel Cladding to Nodular Corrosion", the subject matter of which is herein incorporated by reference, discloses that $\alpha$ Zircaloy-2 with very small precipitates, formed by having been heated to 1010 C and quenched, exhibits high resistance to nodular corrosion. Unfortunately, some research has suggested that small precipitates in the Zircaloy metal matrix can increase the danger of crack propagation in the cladding axial direction [see for example, U.S. patent application Ser. No. 08/052,793 entitled "Zircaloy Tubing Having High Resistance to Crack Propagation" (now U.S. Pat. No. 5,519,748), and U.S. patent application Ser. No. 08/052,791 entitled "Method of Fabricating Zircaloy Tubing Having High Resistance to Crack Propagation" (now U.S. Pat. No. 5,437,747), both assigned to the assignee hereof]. Thus, while zirconium alloy tubing possessing excellent resistance to nodular corrosion may be manufactured, it is frequently necessary to add further annealing heat treatments to achieve other further objectives, such as to reduce the incidence of axial splitting of a Zircaloy-2 tubing. Unfortunately, up until the present invention and the understanding of the concept of critical temperature $T_c$ disclosed in U.S. application Ser. No. 09/050,214, filed Mar. 30, 1998, entitled "Method for Determining Corrosion Susceptibility of Nuclear Fuel Cladding to Nodular Corrosion", such other anneal processes often had detrimental effects on the ability of such zirconium alloy tubing to withstand nodular corrosion. In fact, until the present invention, it was little understood why some annealing processes actually have the effect of sensitizing the tubing to nodular corrosion. It was thus unknown, prior to this invention, how to reliably retain the benefits of a zirconium alloy possessing high resistance to nodular corrosion when further subjecting such tubing to a further anneal for the purposes of increasing such tubing's resistance to axial splitting. It was further unknown, prior to this invention, how to reliably apply an anneal to a zirconium alloy (which may initially prior to such anneal be susceptible to nodular corrosion) so as to completely immunize against nodular corrosion.

SUMMARY OF THE INVENTION

The present invention involves an understanding of known metallurgical structures of Zircaloys, namely α and β crystal lattice structures which are present, either individually or in combination, over certain temperature ranges during annealing of Zircaloy.

The specific α or β metallurgical structures which are present over various temperature ranges are commonly depicted in time-temperature plots referred to as isothermal transformation diagrams ("TTT" diagrams) specific to each Zircaloy. In particular, such diagrams refer to a "β phase", which for zirconium alloys is a body-centered cubic crystal lattice structure of crystalline zirconium, which exists at temperatures above about 825 C, and exclusively exists at temperatures above about 985 C. Such diagrams further refer to the α-matrix phase, or "α phase". The α-matrix phase of a Zircaloy-2 comprises a close-packed hexagonal lattice structure, which exists exclusively at temperatures less than approximately 825 C. Both the α and β phases of Zircaloys may simultaneously each exist at temperatures in the range of about 825–985 C.

Precipitates (herein referred to collectively by the Greek letter χ) also exist within Zircaloys, and are generally particles within the alloy containing higher concentrations of the alloying elements Fe and Cr or Ni. These alloying elements, which exist in solution at low concentrations in the α and β matrices, generally start to precipitate out of solution and form precipitates below temperatures of about 855 C.

Precipitates found in Zircaloys are represented by chemical formulas such as $Zr(Fe, Cr)_2$ and $Zr_2(Fe, Ni)$.

For a given temperature less than about 855 C [ie. for a given temperature less than the temperature of the (α+β)/((α+βprecipitate) transus on the TTT diagram], at equilibrium the concentration of alloying elements Fe, Cr and Ni (ie. solute) in the α-matrix will be no higher than their solubility limit within such α matrix at the given temperature. Lowering the temperature causes such solute to precipitate out of the α-matrix into precipitates and/or to migrate to remaining α phase, if α phase exists at such temperature.

It is postulated that Zircaloys derive their immunity to nodular corrosion from solute present in the α-matrix, the α-matrix being the metallurgical structure present at the temperature at which nuclear reactors operate (ie. in the 200 C–390 C range). Zircaloys which are rapidly cooled from a relatively high temperature (eg. 950 C) [when large amounts of solute may be present in such α-matrix and where such solutes remain trapped in such α-matrix in a supersaturated condition when subsequently rapidly cooled] have high resistance to nodular corrosion, which lends support to such postulate. Likewise supporting such postulate is evidence that slowly cooling a Zircaloy from temperatures commencing at 950 C, whereby the concentration of solute in such α-matrix is thereby given the chance to leave such matrix during the cooling period by, for example, precipitating into precipitates, produces a Zircaloy having an α-matrix phase at temperatures of 200 C–390 C which is highly sensitive to nodular corrosion.

It is now believed that there exists a critical concentration Cc of solute within such α-matrix whereby α-matrices having concentrations of solute therein above such critical concentration Cc will possess an immunity to nodular corrosion, and α-matrices having solute concentrations below such critical concentration Cc will exhibit high susceptibility to nodular corrosion when exposed to steam. Experimental tests conducted by the inventor have allowed the inventor to conclude the critical concentration Cc of solute is reached, when at equilibrium, at a specific critical temperature $T_c$ which, for Zircaloys, exists in the region below the (α+β)/(α+β+χ) transus (ie. below about 855 C) but above the (α+β+χ)/(α+χ) transus (ie. above about 825 C), namely in the (α+β+χ) region on the TTT diagram. In particular, experimental results conducted with Zircaloy-2 indicate this critical temperature $T_c$ to be in the range of 837–841 C, and likely about 840 C. At such temperature the α-matrix containing solute of a concentration Cc exists in equilibrium with solute-saturated β-phase.

Axial splitting of Zircaloy tubing is a further recognized problem. Axial splitting on the surface of such tubing leads to localized stress concentrations and increased corrosion in such cracks, leading to splitting of tubing and thereby contamination of the reactor coolant by the radioactive fuel. It is recognized that an anneal applied to the surface of zirconium alloy tubing which is exposed to water/steam in a nuclear reactor, at a temperature below about 855 C, [namely at a temperature on the TTT diagram in the region where precipitates form, namely in the α+β, α+β+χ and α+χ regions] but above the critical temperature, in addition to immunizing against nodular corrosion will cause precipitates formed within such alloy below such temperature to coarsen, namely grow larger in size, and such has the beneficial result of reducing instances of axial splitting of such tubing on the surface of such tubing (hereinafter referred to as a "coarsening anneal").

Using the concept of $T_c$, it is now realized that annealing a zirconium alloy at a temperature above the critical temperature $T_c$, but below approximately 855 C where precipitates form, namely below the α+β+precipitate)/(α+β) transus temperature for the particular zirconium alloy, will, when subsequently rapidly cooled, results in an alloy possessing both coarsened precipitates and at the same time a resistance/immunity to nodular corrosion. Likewise, it is now recognized, using the concept of $T_c$, that annealing a zirconium alloy at a temperature above the critical temperature $T_c$ but below the (α+β+precipitate)/(α+β) transus temperature for the particular zirconium alloy will even cause a zirconium alloy not originally possessing immunity to nodular corrosion to then possess an immunity to nodular corrosion by coarsening of any and all intermetallic grain structures.

Accordingly, in one of its broad aspects the present invention teaches a method of immunizing and/or increasing resistance of a surface of zirconium alloy tubing exposed to high pressure steam to nodular corrosion.

In another of its broad aspects the present invention comprises a method of immunizing and/or increasing resistance of a surface of zirconium alloy tubing to nodular corrosion, while at the same time coarsening precipitates formed during the anneal process.

More particularly, in one of its broad aspects the present invention teaches a method of immunizing and/or increasing resistance of a surface of zirconium alloy tubing to nodular corrosion, comprising:

(i) heating said surface of said tubing to a temperature within a temperature range bounded at its lower limit by a temperature $T_c$, namely the temperature which at equilibrium conditions sufficient solute would exist in α-matrices of said zirconium alloy to resist nodular corrosion, and bounded at its upper limit by a temperature of the (α+β+precipitate)/(α+β) transus inherent for the particular zirconium alloy;

ii) maintaining the temperature of said surface within said temperature range for a selected period of time; and iii) subsequently causing said temperature of said surface to be reduced at a rate sufficiently rapid to prevent substantial loss of solute concentration from said α-matrices.

In another of its broad aspects, the present invention thus teaches a method of increasing resistance of a surface of zirconium alloy tubing to nodular corrosion, comprising:

(i) heating such surface of said tubing to a temperature within a temperature range bounded at its lowest limit by a temperature $T_c$, namely the temperature at which at equilibrium conditions sufficient solute would exist in α-matrices of said zirconium alloy to resist nodular corrosion, and bounded at its upper limit by a temperature of the (α+β+precipitate)/(α+β) transus on the isothermal transformation temperature diagram for the particular zirconium alloy;

(ii) maintaining said surface within said temperature range for a time period sufficient to allow an increase in the average size of a portion of intermetallic particles formed within said alloy at said surface; and (iii) subsequently causing said temperature of said surface to be reduced at a rate sufficiently rapid to prevent substantial loss of solute concentration in said α-matrices.

In still a further aspect of the present invention, a zirconium alloy tubing is taught, said tubing comprising:

(i) a surface which has been heated to a temperature within a temperature range bounded at its lower limit by a temperature $T_c$, namely the temperature at which at equilibrium conditions sufficient solute would exist in α-matrices of said zirconium alloy to resist nodular corrosion, and bounded at its upper limit by a temperature of the (α+β+precipitate)/(α+β) transus on the isothermal transformation temperature diagram for the particular zirconium alloy; and (ii) said surface having been maintained within said temperature range for a time period sufficient to allow an increase in the size of intermetallic particles formed within said surface, and subsequently thereafter cooled.

In each of the above three aspects of the invention, where the zirconium alloy is Zircaloy-2 comprised of zirconium and the following metals in approximate weight percentages, namely 1.2–1.7% tin, 0.13–0.20% iron, 0.06–0.15% chromium, and 0.05–0.08% nickel, the corresponding critical temperature $T_c$ is in the range of about 837–841 C, preferably approximately 840 C, and the temperature of the (α+β+precipitate)/(α+β) transus is approximately 855 C.

The holding time pursuant to which such surface is held within such temperature range may vary within the range of anywhere from greater than 2 seconds to over 20 hours. For example, the holding time may be greater than 20 seconds, greater than 30 seconds, greater than 1 minute, and up to 20 hours or more. Preferably the holding time is in the range of approximately 30 minutes to two hours, to give sufficient time to allow intermetallic particles to increase in size and to immunize against nodular corrosion. Typically, the step of reducing the temperature after exposure to such temperature comprises cooling the surface by quenching. During quenching, the temperature may be reduced at a rate of at least 1° C./sec., typically at least 3° C./sec, for example.

The special protective anneal of the present invention, due to being carried out at a temperature range not exceeding the temperature of the (α+β+precipitate)/α+β) transus on the isothermal transformation temperature diagram, is able to increase resistance to nodular corrosion with the original precipitates present. Annealing at a higher temperature anneal above not only $T_c$ but also above the (α+β+precipitate)/(α+β) transus would otherwise re-dissolve all precipitates as no precipitates may exist above such transus. Upon cooling such would leave a distribution of very small new precipitates and not produce the more desirable larger size precipitates as in the case of the present invention, which, it is believed, reduces the susceptibility of the Zircaloy-2 tubing to axial splitting.

BRIEF DESCRIPTION OF THE DRAWINGS

In considering the detailed description of the embodiments of the present invention which follows, reference is to be had to the attached drawings in which:

FIG. 2 is a tabulation of the results of various experiments, as more fully described herein, wherein equiaxed a Zircaloy-2 was furnace cooled from 1010 C to 840/830 C, and thereafter slow-cooled to a selected temperature ranging from 840–808 C, and held at such temperature for a time "t", and thereafter quenched and exposed to steam at 510 C, 1500 psig for 24 hours to determine if nodular corrosion occurred;

DETAILED DESCRIPTION OF THE INVENTION

Figure 1:
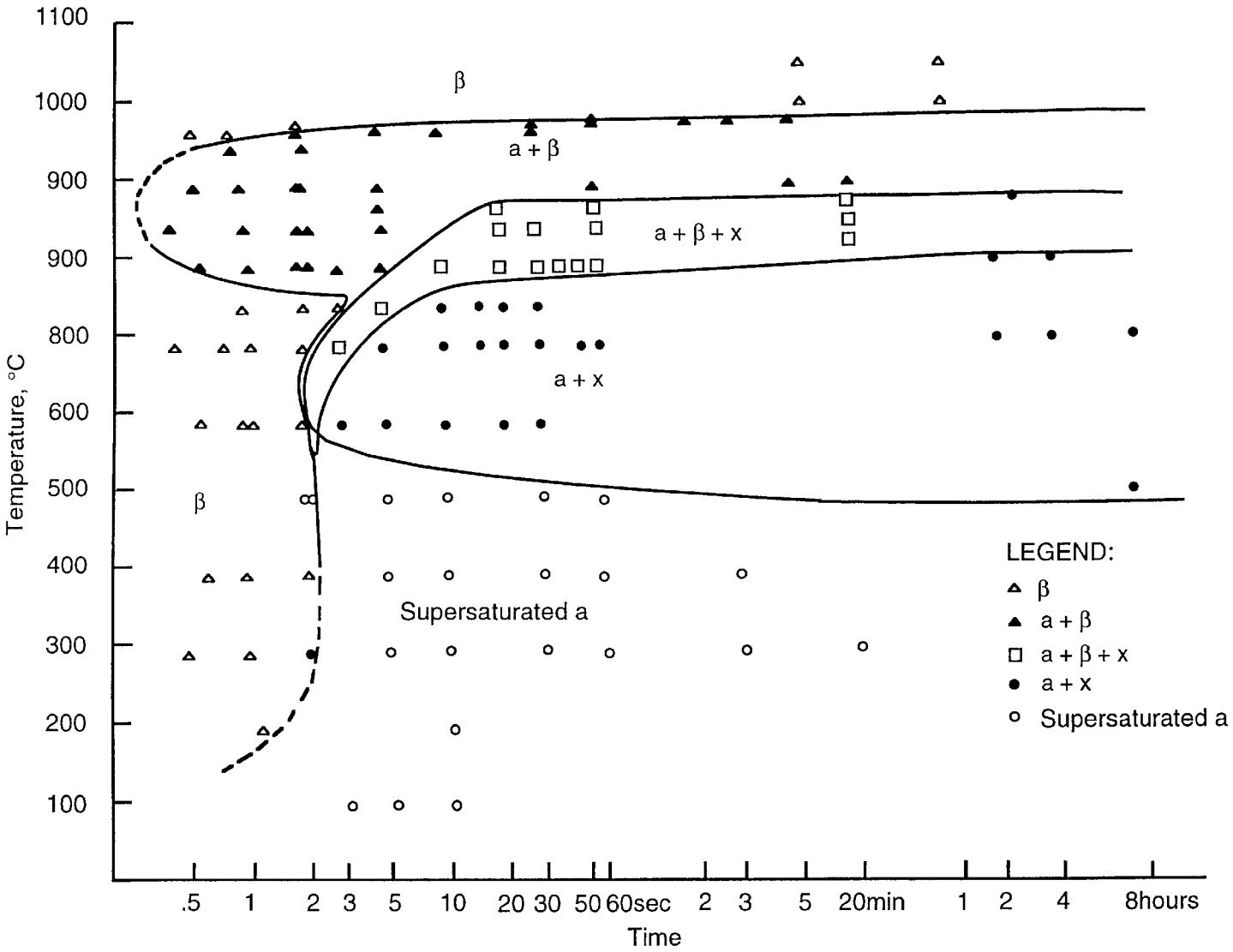
FIG. 1 is a typical isothermal transformation diagram of temperature and physical structure as a function of time for Zircaloy-2 zirconium alloy, after heating to 1050 C, identifying the microscopic crystalline structures present within such alloy over various temperature ranges and times [ref. G. Ostberg, Jerkontorets Annaler, 145 (1961), p. 119]

FIG. 1 shows a typical TTT diagram for a zirconium alloy, namely Zircaloy-2, which contains by weight percent 1.5% Sn, 0.15% Fe, 0.1% Cr, and 0.5% Ni. FIG. 1 shows the microstructural phases of Zircaloy present over various temperature ranges, as a function of cooling time, with the β phase being present at temperatures above approximately 985 C, with the α+β phases both being present in temperatures typically in the range of 855–985 C, and with a, a and a precipitate χ phase being present in the range of about 825–855 C.

The method of the present invention comprises heating the surface of such alloy to a temperature within a temperature range in which the α, β and precipitate phases exist, such temperature range bounded on its upper limit by the uppermost temperature at which the precipitate phase exists at equilibrium conditions, namely at the temperature of α+βprecipitate)/(α+β) transus for long exposure times. Such upper limit temperature, for the Zircaloy-2 zirconium alloy, is about 855 C, as may be seen from FIG. 1. The temperature range is bounded at its lower limit by what is realized now to be a critical temperature, $T_c$, which is the temperature which at equilibrium conditions sufficient solute would exist in α-matrices of the zirconium alloy to resist nodular corrosion. In particular, at equilibrium conditions, the solute concentration in the α-zirconium matrix (one of the microstructural phases present in the α+βχ region, the other phases being the β-matrix phase, and precipitates χ) is relative to temperature. Increased temperature increases the α-matrix's ability to hold therewithin increased quantities of solute, while lowering the temperature reduces the solute concentration within the α-matrix as a precipitate χ, causing solute to diffuse or precipitate out of such α-matrix. It is assumed that zirconium alloys derive their immunity to nodular corrosion from solute present in the α-zirconium matrix. As a result of experimental results (see below), it is believed that there is a critical concentration $C_c$ of solute (and thus a corresponding temperature $T_c$ at which solute may exist in the necessary concentration within the α-matrix) necessary to resist nodular corrosion. Such experiments indicate the corresponding temperature $T_c$ for solute to exist in sufficient concentrations lies within the α+β+χ phase field, namely the phase field intermediate the (α+χ)/(α+β+χ) transus and the (α+1)/(α+β+χ) transus temperatures (see FIG. 1).

The experimental procedure used to determine the critical temperature $T_c$ for Zircaloy-2 is described below.

EXAMPLE 1

Zircaloy-2 nuclear fuel cladding with a zirconium barrier liner from Tubing Lot 2054-06 was used. Such cladding was obtained from parent ingot UX2700LB of commercial Zircaloy-2 having deliberate additions of Si and C, comprising (all weight percent) 1.28–1.31 Sn, 0.15–0.17 Fe, 0.09–0.10 Cr, 0.06–0.07 Ni, 0.12–0.13 O with less than 40 ppm N, 97–112 ppm Si, and 132–154 ppm C.

The annealing (heating) furnace used comprised a 25 mm diameter quartz tube that passed vertically through a bank of radially symmetric heating elements. A Type-304 stainless steel hook suspended a single 1 mm Zircaloy tubing segment in the center of the hot zone with its axis approximately horizontal. The tips of two 3 mm stainless steel thermocouple wells contacted the central portion of the tubing segment's external surface, one on each side of the suspension hook, and held the control and monitor thermocouples in close proximity to the Zircaloy specimen. Research-grade argon gas flowed at a constant rate of 60 cc/min through a getter of Zr—Ti alloy turnings at 800 C before reaching the annealing zone of the quartz tube.

To strictly control furnace temperature, and to change it in accordance with temperature patterns described below, Programmable Research, Inc. Dimension Process Controller was used.

Heating generally comprised heating at a constant rate averaging about 40 C/min., to a maximum temperature. "Slow cooling" or "Slow cool", as referred to below, comprised a program control, and consisted of an allowed cooling rate of 0.005 C/sec. (18 C/hr.). "Furnace cooling" or "Furnace cool", as referred to below comprised a natural rate of cooling with the electrical power to the furnace shut off and the heating elements still in place, and varied from about 0.7 C/sec. to 0.6 C/sec. "Fan cooling" or "Fan cool" comprised opening the heating chamber and fan-cooling the quartz tube, which resulted in a quench rate that typically started at a rate of about 3 C/sec., but decreased to 1 C/sec. by the time the temperature reached 500 C. Changes from "slow cooling" to "furnace cooling" or "fan cooling" were abrupt and precise, but the transitions from "furnace cooling" to "slow cooling" required a gradual approach to avoid undershoot.

Numerous annular cuttings of the Zircaloy tubing were made as specimens. Each were subsequently etched with gentle agitation for 60 seconds in a solution of 10:9:1 by volume water, 70% nitric acid, 50% hydrofluoric acid. Each were then subjected to a similar but for each case individually different heating and cooling regime. In particular, such samples were each heated to a high temperature (in the β phase region on the TTT diagram, namely 1010 C), furnace cooled to either 830 C or 840 C (the former if $T_f$<825 C, and the latter if $T_f$>825 C), slow cooled to a temperature $T_f$, held at such temperature for a time "t", and thereafter fan-cooled. The hold times "t" used were t=0, 2, 5,18 and 48 hrs. $T_f$ changed in increments of 3 C for t=0 (no hold time before quenching, i.e. fan cooling), 2 C for t=2 hr., 5 hr., and 18 hr., and 1 C for t=48 hr. The hold temperature $T_f$ used varied over the range 840 C to 808 C. Accordingly, the heating/cooling pattern for each specimen utilized was "1010 C/furnace cool to 830 C ($T_f$<825 C) or 840 C ($T_f$>825 C)/slow cool to $T_f$/hold for t hr./fan cool."

Each of the specimens after fan cooling were re-etched, and exposed to a standard steam test. Such steam testing was by exposure to 10.4 MP (1500 psig) steam at 510 C for 24 hr. A convection oven held the temperature throughout the interior of a one-liter Type 316 stainless steel autoclave constant to within ±1 C. A metering pump maintained the flow rate of 18 MΩ-cm water at 20 cc/min. after oxygen removal by nitrogen saturation under ambient conditions.

FIG. 2 is a tabulation of the results obtained, correlating the hold time at a plurality of temperatures to whether the specimens were made susceptible to nodular corrosion. As may be seen, as the time increased, the temperature at which nodular corrosion occurred moved from 812 C (0 hours) to 838 C (48 hours). It is believed the more lengthy time periods indicated a more equilibrated state wherein the excess solute within the α-matrix had time to migrate out of such matrix if the solubility limit at such temperature did not permit it to remain in the α-matrix. Thus the temperature at which nodular corrosion existed moved closer to what is believed to be $T_c$, the critical temperature at equilibrium conditions, below which the solubility limit within the α-matrix is insufficient to maintain a concentration of solute sufficient to resist nodular corrosion.

Figure 3:
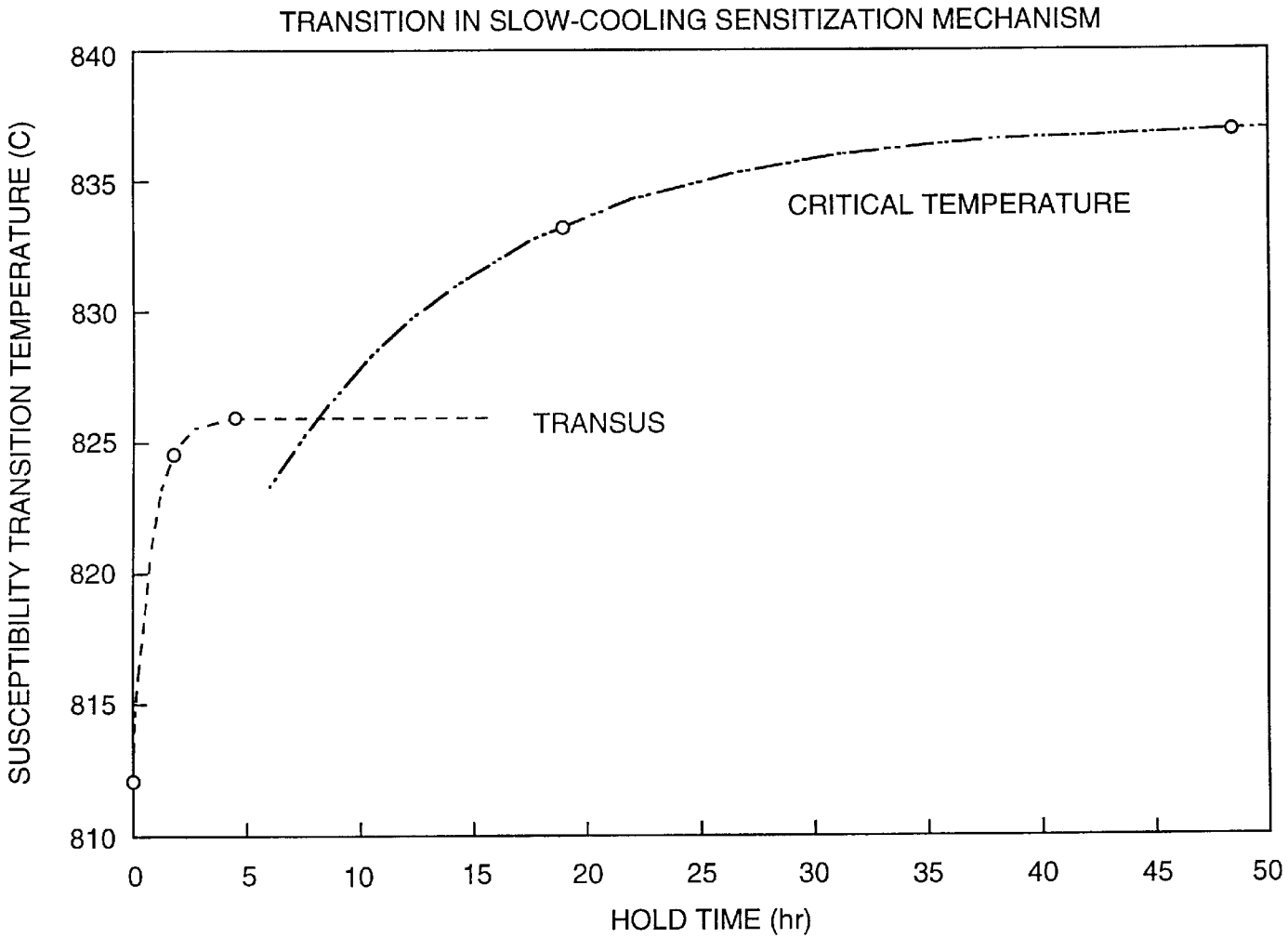
FIG. 3 is a graph showing the highest temperatures at which nodular corrosion was observed, taken from the results tabulated in FIG. 2.

FIG. 3 is a graphical representation of the onset temperatures of nodular corrosion obtained from the results obtained in FIG. 2, namely t=0 hrs. (812 C), t=2 hrs. (825 C), t=5 hrs. (826 C), t=18 hrs. (833 C), and t=48 hrs. (837 C).

As may be seen from FIG. 3 as time increases, the temperature at which nodular corrosion occurs appears to approach a definite limit $T_c$. While the actual value of $T_c$ may be easily more precisely determined by further experimentation using more lengthy hold times, it is sufficiently easy from the values obtained to calculate a definite mathematic result for $T_c$.

More particularly, the simplest function that matches the asymptotic characteristics of these data is of the form $(1-e^{-x})$. Analytical representation requires three fitting parameters, $T_o$ (the intercept at zero hold time t=0), $T_L$ (the limiting value for long hold times, which will be $T_c$), and "j", an arbitrary co-efficient of the hold time. The resulting empirical equation:

$$T=T_L-(T_L-T_o)e^{-jt} \quad (1)$$

required at least three points to determine those parameters. FIG. 3 shows two asymptotic curves, and thus three points are needed for each of the two curves. The first curve (having the three points 812 C, 825 C, and 826 C (t=0 hr., 2 hr., and 5 hr.) is inapplicable in determining $T_c$, due to the intervening phase transformation. For the second curve, having only two points (T=833 C at t=18 hr., and T=837 C at t=48 hr.), it was necessary to supply a third point. Since the curves had to intersect between t=5 hrs. and t=18 hrs. with T=826 C827 C, a third point could be selected. Using the three points:

T=826 C t=5 hrs.
T=833 C t=18 hrs.
T=837 C t=48 hrs.

and solving for $T_L$ (ie. $T_c$) in above equation (1) gives a value for $T_c$ in the range of 837–838 C for the Zircaloy-2 specimen tested.

With such value of $T_c$ (namely approximately 840 C), the method of the present invention can be practiced.

EXAMPLE 2

Four specimens (designated A, B, C and D) of Zircaloy-2 tubing (1.46 inch outside diameter) were obtained for the purposes of examining the effect of a protective coarsening anneal provided by the method of the present invention.

Such four specimens were obtained after the initial "breakdown pass" of the fuel tube manufacturing process, where no in-process heat treatment was utilized. Each of the four specimens were, prior to the method of the present invention being practiced upon them, subject to a standard anneal of 621 C for 1.5 hours.

Thereafter, with the exception of Specimen A which was used as the control specimen, each of the remaining three specimens were each heated to a temperature of 841 C, such temperature being just above the determined temperature Tc of 840 C for Zircaloy-2, but just below the (α+β+precipitate)/(α+β) transus temperature of approximately 855 C for such zirconium alloy, and held at 841 C for 0.5 hours (Specimen B), 1.0 hours (Specimen C), and 2.0 hours (Specimen D).

Figure 4A:
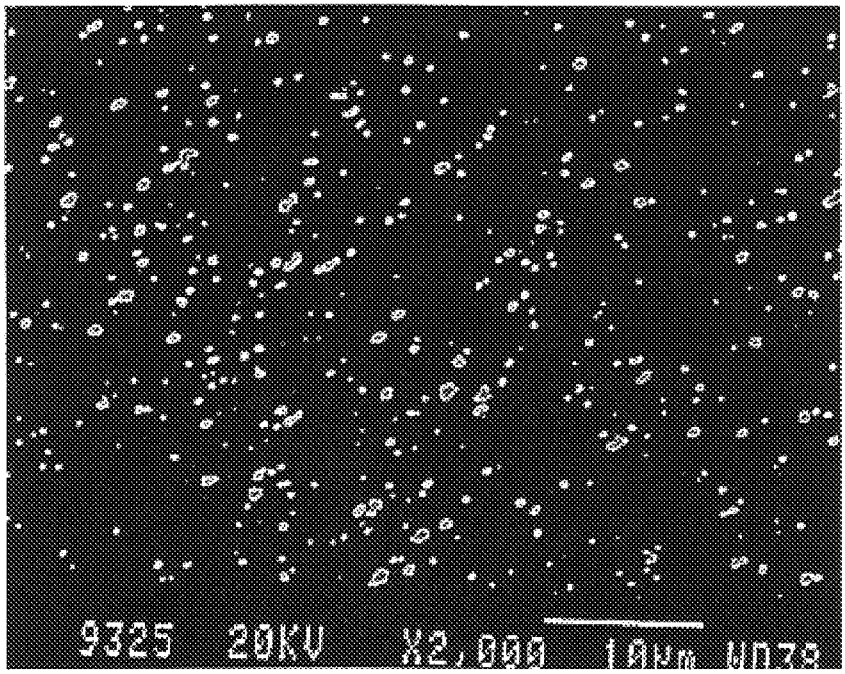
FIGS. 4A and 4B are scanning electron microscope images of a Zircaloy-2 specimen [Specimen A of Table 1] which has not been subject to the process of the present invention, magnified 2000 times.
Figure 4B:
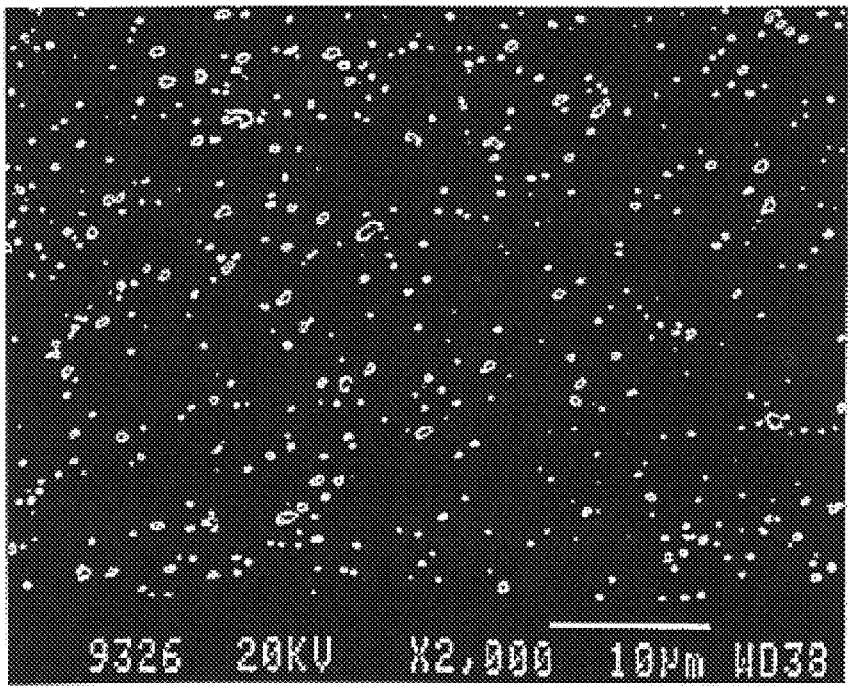
Figure 5A:
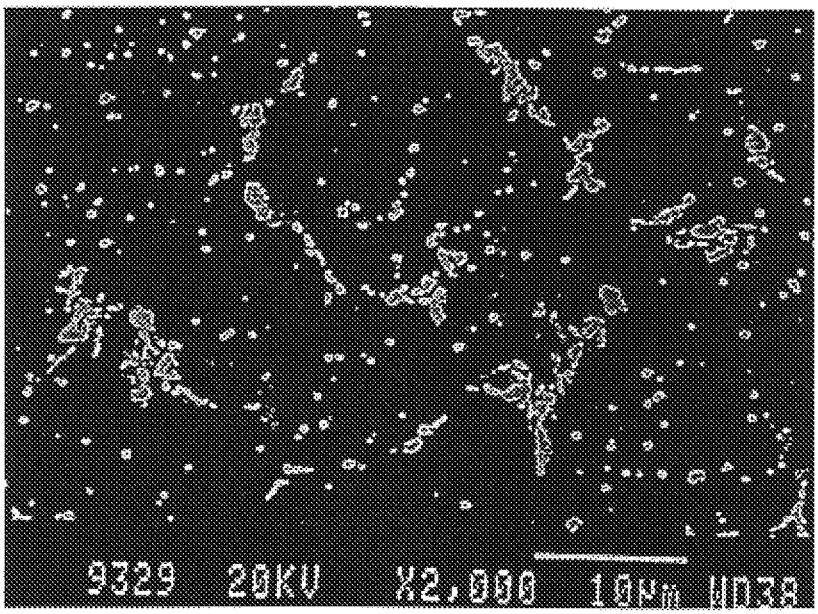
FIGS. 5A and 5B are scanning electron microscope images of a Zircaloy-2 specimen [Specimen B of Table 1], magnified 2000 times, after being subjected to a temperature of 841 C for a period of 0.5 hours.
Figure 5B:
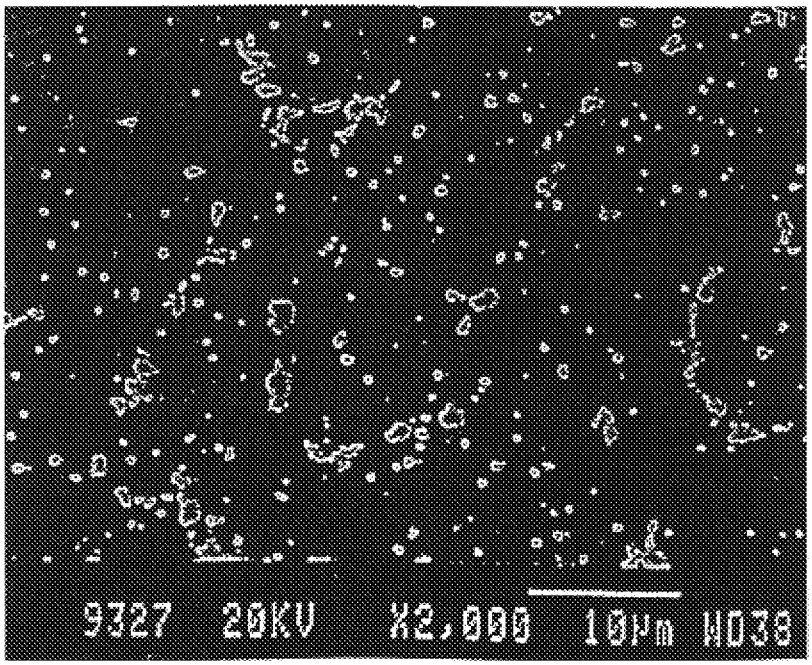
Figure 6A:
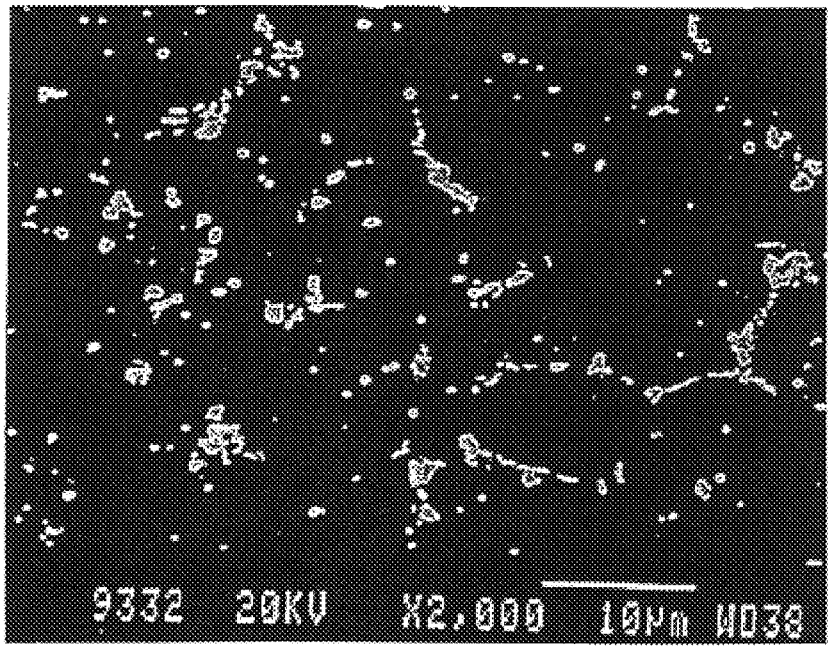
FIGS. 6A and 6B are scanning electron microscope images of a Zircaloy-2 specimen [Specimen C of Table 1], magnified 2000 times, after being subjected to a temperature of 841 C for a period of 1.0 hours.
Figure 6B:
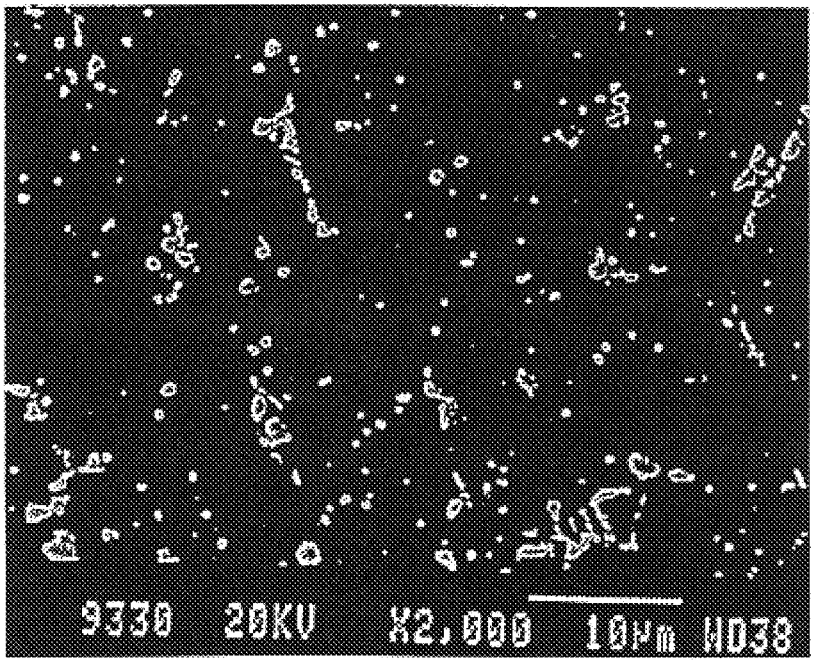
Figure 7A:
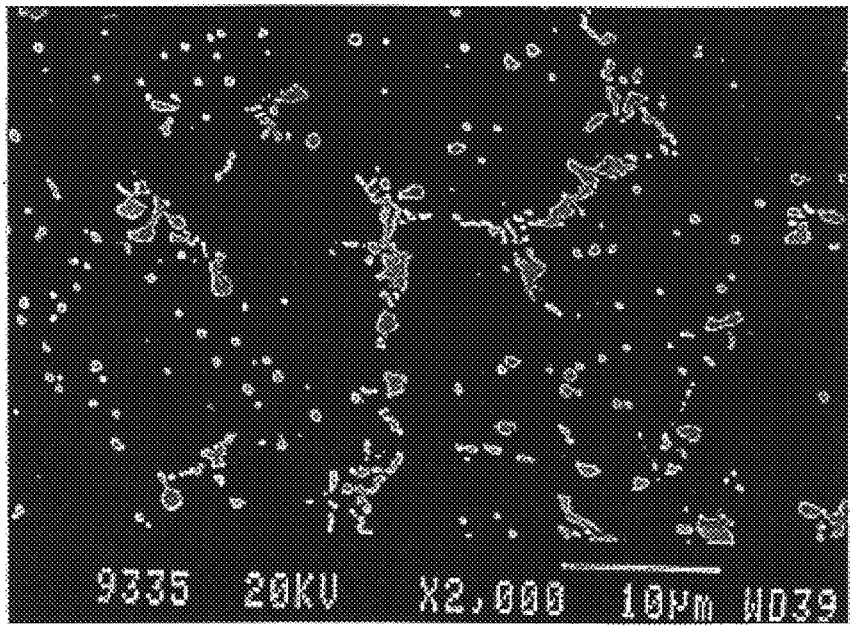
FIGS. 7A and 7B are scanning electron microscope images of a Zircaloy-2 specimen [Specimen D of Table 1], magnified 2000 times, after being subjected to a temperature of 841 C for a period of 2.0 hours.
Figure 7B:
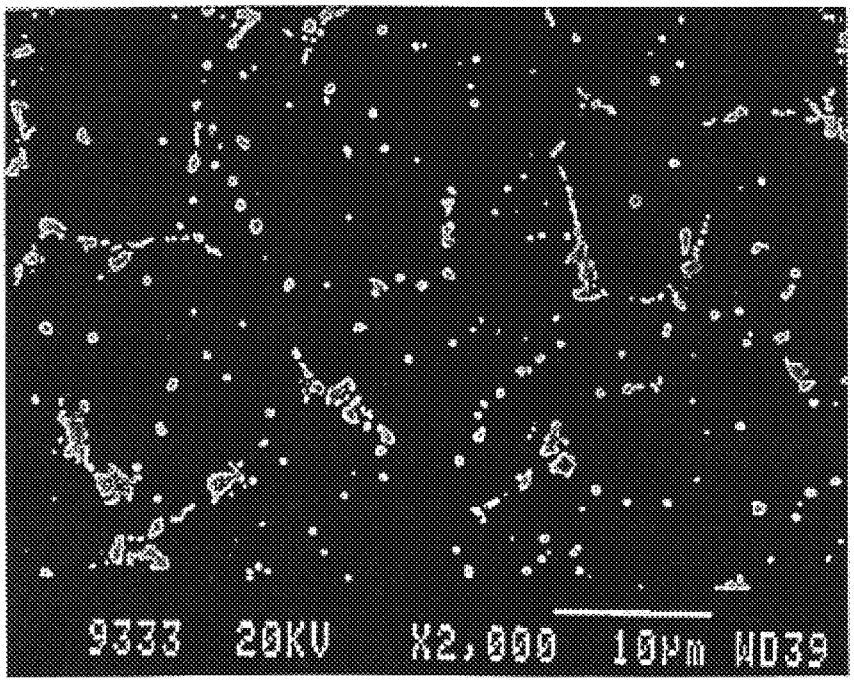
Figure 8A:
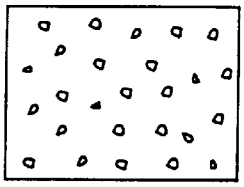
FIG. 8 is a pictoral representations of Specimens A–D as after treatment in accordance with the steps set out in Example 2.
Figure 8B:
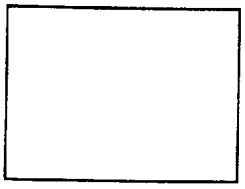
Figure 8C:
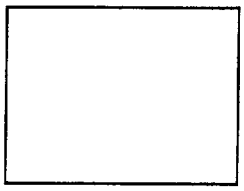
Figure 8D:
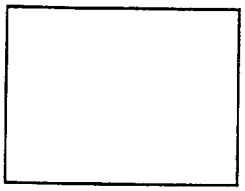

Upon completion of such times, the three specimens were each brought to room temperature by air (fan) quenching/cooling. The four samples were each then sectioned into three pieces, and one piece of each was mounted, polished, and sputter-coated with 100 Å of gold, to allow for scanning electron microscope examination. FIGS. 4–7 show photographs of the surface features of the four samples (specimens A–D respectively). Two images (photographs) A and B, each magnified 2000×, were taken in respect of each sample, from different areas of each sample. For example, FIGS. 5A and 5B are two scanning electron microscope photographs of Sample B, while FIGS. 6A and 6B are two scanning electron microscope photographs of Sample C.

In comparing the photographs of specimens B, C and D (FIGS. 5A & 5B, 6A & 6B, and 7A & 7B) which had the coarsening anneal of the present invention applied to them, the mean size of intermetallic precipitates formed within each sample may be seen to be significantly larger than those of specimen A (ref. FIGS. 4A & 4B) which did not have the protective coarsening anneal of the present invention applied to it.

For further study of the effectiveness of the coarsening anneal, a second piece of each of the four tubing segments A–D were further wafer cut with a diamond saw into thin sections (approximately 0.01" thick), near the midwall to allow for transmission electron microscope study. Intermetallic particle size measurements were made on each of the four tubing segments which had been cut from the respective segments, and are summarized in Table 1 below.

TABLE 1

| Sample | Heat treatment | Mean. μm | Std. Dev. μm | Median μm | Lowest μm | Highest μm | No. Counted |
|---|---|---|---|---|---|---|---|
| A | Standard | 0.127 | 0.061 | 0.112 | 0.050 | 0.478 | 203 |
| B | 841° C./0.5 hr. | 0.150 | 0.082 | 0.122 | 0.044 | 0.466 | 203 |
| C | 841° C./1.0 hr. | 0.177 | 0.092 | 0.154 | 0.055 | 0.600 | 205 |
| D | 841° C./2.0 hr. | 0.217 | 0.112 | 0.193 | 0.066 | 0.874 | 155 |

As may be seen from the above results, the effect of practicing the method of the present invention has been to grow the intermetallic particle size. As may clearly be seen, increased particle size is generally proportionate to the length of protective coarsening anneal time provided (when at a temperature within the temperature range of the present invention).

Moreover, as now understood from the results obtained from Example 1, the effect of annealing at temperatures above 840 C immunizes surfaces of the samples to nodular corrosion. In this regard, a standard steam test was conducted on the third piece of each of the Samples A, B, C & D. In particular, each of the third specimen of Samples A, B, C & D were subsequently exposed to steam at 510 C at 1500 psig., for a period of 24 hours. The results of such test on Samples A–D are shown in FIG. 8.

As may be seen from FIG. 8, the third specimen of Sample A (control sample) developed a moderate to heavy coating of nodules, while specimens of Samples B, C & D which had been exposed to the process of the present invention as described above were covered with a shiny black oxide and showed no detectable nodular corrosion.

EXAMPLE 3

Three specimens, likewise designated A, B & C of Zircaloy-2 tubing (1.46" outside diameter) were similarly obtained, again after the initial "breakdown pass" of the fuel tube manufacturing process, where no in-process heat treatment was utilized. Each of the three specimens were, prior to the method of the present invention being practiced upon them, subject to an anneal of 750 C for 24 hours.

Thereafter, with the exception of Sample A which was used as the control sample, each of the remaining two samples were each heated to a temperature of 842 C, and held at 842 C for 0.5 hours (Sample B), and 1.0 hours (Sample C).

A standard steam test was likewise conducted on each of the Samples A, B & C. In particular, each of Samples A–C were subsequently exposed to steam at 510 C at 1500 psig., for a period of 24 hours. The results of such test on Samples A–C are shown in FIG. 9.

Figure 9A:
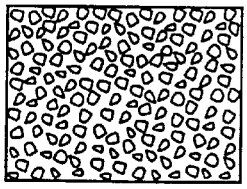
FIG. 9 is a pictoral representation of Samples A–C after treatment in accordance with the steps set out in Example 3.
Figure 9B:
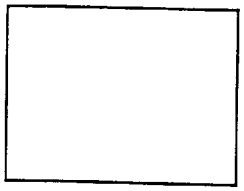
Figure 9C:
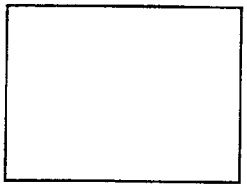

As may be seen from FIG. 9, Sample A (the control sample) developed a heavy coating of white nodules, while Samples B & C which had been exposed to the processes of the prevent invention as described above were covered with a shiny black oxide and showed no delectable nodular corrosion.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

I claim:

1. A zirconium alloy tubing that is resistant to axial splitting and nodular corrosion, said zirconium alloy tubing comprising an α-matrix containing a solute, wherein said solute comprises at least one of iron, chromium, and nickel and is present above a critical concentration, said zirconium alloy tubing having been prepared by: heating a surface of said zirconium alloy tubing to a temperature within a temperature range bounded at its lower limit by a temperature $T_c$ at which, under equilibrium conditions, said solute is present in said α-matrix in a concentration greater than said critical concentration, and bounded at its upper limit by a temperature of the (α+β)/(α+β+precipitate) transus inherent for the particular zirconium alloy; maintaining the temperature of said surface within said temperature range for a period of time greater than 2 seconds; and subsequently causing said temperature of said surface to be reduced at a rate sufficiently rapid to prevent substantial loss of solute concentration from said α-matrix.

2. A zirconium alloy tubing that is resistant to axial splitting and nodular corrosion, said zirconium alloy tubing comprising an α-matrix containing a solute present above a critical concentration and having a surface, said surface having a coarsened intermetallic grain structure, said coarsened intermetallic grain structure having been formed by: heating said surface to a temperature within a temperature range bounded at its lower limit by a temperature $T_c$ at which, under equilibrium conditions, said solute is present in said α-matrix in a concentration greater than said critical concentration, and bounded at its upper limit by a temperature of the (α+β)/(α+β+precipitate) transus inherent for the particular zirconium alloy; maintaining said surface within said temperature range for a time period of at least about one minute, thereby increasing the size of intermetallic particles formed within said surface; and subsequently cooling said surface.

3. The zirconium alloy tubing as claimed in claim 2, said tubing comprising zirconium and the following metals in the following percentages by weight, namely 1.2–1.7% tin, 0.13–0.20% iron, 0.06–1.5% chromium, and 0.05–0.08% nickel.

4. The zirconium alloy tubing as claimed in claim 3, wherein $T_c$ is approximately 840 C and said temperature of the (α+β+precipitate)/(α+β) transus is approximately 855 C.

5. The zirconium alloy tubing as claimed in claim 2, wherein said time period is at least 1 minute.

6. The zirconium alloy tubing as claimed in claim 2, wherein said step of cooling said surface comprises the step of quenching said surface to cause cooling thereof at a rate greater than or substantially equal to 0.6 C per second.

7. A zirconium alloy that is resistant to axial splitting and nodular corrosion, said zirconium alloy comprising an α-matrix containing a solute, wherein said solute comprises at least one of iron, chromium, and nickel and is present above a critical concentration, wherein said zirconium alloy having been prepared by: heating said zirconium alloy to a temperature within a temperature range bounded at its lower limit by a temperature $T_c$ at which, under equilibrium conditions, said solute is present in said α-matrix in a concentration greater than said critical concentration, and bounded at its upper limit by a temperature of the (α+β)/(α+β+precipitate) transus inherent for the particular zirconium alloy; maintaining the temperature of said zirconium alloy within said temperature range for a period of time greater than about 2 seconds; and subsequently causing said temperature of said zirconium alloy to be reduced at a rate sufficiently rapid to prevent a substantial loss of solute concentration from said α-matrix.

* * * * *